US005176605A

United States Patent [19]

Focke

[11] Patent Number: 5,176,605

[45] Date of Patent: Jan. 5, 1993

[54] FOLDING DEVICE FOR PRODUCING CIGARETTE PACKS

[75] Inventor: Heinz Focke, Verden, Fed. Rep. of Germany

[73] Assignee: Focke & Co., Verden, Fed. Rep. of Germany

[21] Appl. No.: 815,032

[22] Filed: Dec. 31, 1991

[30] Foreign Application Priority Data

Jan. 7, 1991 [DE] Fed. Rep. of Germany ..... 4100239

[51] Int. Cl.[5] ..... B65B 19/28; B31B 1/32

[52] U.S. Cl. ..... 493/31; 53/52; 53/507; 53/575

[58] Field of Search ..... 53/52, 507, 575; 493/30, 31, 32, 33

[56] References Cited

U.S. PATENT DOCUMENTS

| | | | |
|---|---|---|---|
| 840,187 | 1/1907 | Abbott | 53/507 |
| 1,159,276 | 11/1915 | Rose | 493/188 |
| 3,416,410 | 12/1968 | Whitaker | 493/31 |
| 4,441,302 | 4/1984 | Gabbitas et al. | 53/52 |
| 4,607,252 | 8/1986 | Neri | 493/31 |
| 4,852,335 | 8/1989 | Focke et al. | 53/575 |

FOREIGN PATENT DOCUMENTS

| | | | |
|---|---|---|---|
| 272337 | 6/1988 | European Pat. Off. | 53/507 |
| 2362771 | 6/1975 | Fed. Rep. of Germany . | |
| 3545884 | 7/1987 | Fed. Rep. of Germany . | |
| 3700928 | 7/1987 | Fed. Rep. of Germany . | |
| 2125544 | 3/1984 | United Kingdom . | |

*Primary Examiner*—William E. Terrell

*Attorney, Agent, or Firm*—Sughrue, Mion, Zinn Macpeak & Seas

[57] ABSTRACT

Folding mandrels (11) of a folding turret (10) are in the form of elongate thin-walled hollow bodies and are susceptible to mechanical stress. The folding mandrels (11) are monitored by a monitoring unit (13) with inductive tracers (14, 15; 29, 30) as regards correct arrangement and shape. Any changes in the shape of the mandrels actuate an error signal which is is assigned to the respective folding mandrel (11). The tracers may be arranged on one side of the path of movement of the folding mandrels (11) at different distances thereto. Alternatively, tracers can be installed at equal distances on either side of the path of movement of the folding mandrels (11).

14 Claims, 5 Drawing Sheets

FOLDING DEVICE FOR PRODUCING CIGARETTE PACKS

BACKGROUND OF THE INVENTION

The invention relates to a folding device, especially a folding turret for producing packs, preferably soft-cup cigarette packs, made from at least one foldable blank, said device comprising unilaterally mounted rotating supporting means (folding mandrels) for the blanks or packs.

In the production of certain types of packs, specifically so-called soft cups for cigarettes, the blanks are folded on outer surfaces of folding mandrels in order to form the pack. These folding mandrels are elongate hollow bodies with a rectangular cross-section corresponding to the contour of the pack. The pack contents (cigarette group) are pushed through the inside space of the folding mandrels, which are open at both ends, and into the nearly completely folded pack which is arranged on said folding mandrel.

During the folding or filling process, the unilaterally projecting folding mandrels are continuously moved by a conveyor, especially a folding turret. Because of their specific arrangement (unilateral attachment) and their geometric shape and their dimensions, the folding mandrels are susceptible to mechanical stress. It can not be ruled out that the folding mandrels are deformed in an undesirable manner when the packaging machine is in operation. If these deformations exceed a certain level, they will cause malfunctions in the packaging process which result in the production of defective packs. The packaging machine has to be stopped and the deformed folding mandrels has to be identified and reshaped or replaced. This process is very time consuming.

SUMMARY OF THE INVENTION

The invention is based on the object to design a folding turret of the above described type in such a way that in the case of undesirable or inadmissible deformations of the folding mandrel, an error signal is generated which facilitates the removal of the defect.

To attain this object, the folding turret according to the invention is characterized by a stationary installation (monitoring unit) which is associated with the folding turret or the like and monitors deformations of the folding mandrels or the like, such that the monitoring unit detects undesirable deformations of the folding mandrels and generates an error signal which is assigned to the respective folding mandrel.

Accordingly, the invention provides to trace the contours or the relative position of the folding mandrel without any contact. If a certain tolerance limit regarding the deformation of the folding mandrels is exceeded, the monitoring unit generates a defined error signal which identifies the deformed folding mandrel. The packaging machine or the folding turret are stopped for a short while in order to reshape or replace the defective folding mandrel. There is no need for a laborious and time-consuming search for the defective folding mandrel.

According to the invention, inductive tracers of a known design are used for tracing the contours or relative positions of the folding mandrels. These inductive tracers form part of the monitoring unit and are arranged in close proximity with the circular path of the folding mandrels, such that they detect and identify any changes in the folding mandrels without contacting them.

According to an exemplary embodiment, two inductive tracers are successively arranged at the outer periphery of the path of movement of the folding mandrels. The inductive tracers or their tracer heads are arranged at different distances to the path of movement of the folding mandrels, such that in the case of correctly formed folding mandrels, each folding mandrel acts upon the inductive tracer with the smaller distance to the path of the mandrels, whereas the other inductive tracer is not acted upon because of its greater distance to the path of the mandrels. If there occur as an undesirable deformation of one of the folding mandrels, either both inductive tracers are acted upon by the respective folding mandrel or - depending on the direction of the deformation - none of the inductive tracers is acted upon if the folding mandrel is located beyond the effective range of both inductive tracers as a result of the deformation.

The folding mandrels may be provided with markings, which are traced by the tracer means of the monitoring unit. If, however, inductive tracers are used, the invention provides that longitudinal edges of the cross-sectionally rectangular folding mandrels are traced.

The tracer means, especially inductive tracers, may also be arranged on opposite sides of the path of movement of the folding mandrels, i.e. radially on the inside and outside.

In this case, both inductive tracers can be located at equal distances to the desired circular path of the folding mandrels, since deformations in the one or the other direction are always detected by either the one or the other inductive tracer.

The preferred inductive tracers are also known in the art as proximity switches. These switches are electronic tracer means with a tracer head for producing an electromagnetic field. If a metallic article approaches the tracer head, a signal is generated as soon as the article reaches the effective range (switch range) of the proximity switch. The present exemplary embodiment employs proximity switches or inductive tracers with a switch range of 4 mm. If a (metallic) marking or a longitudinal edge of the folding mandrel selected according to the invention enters the effective range of the inductive tracer, a signal is generated.

BRIEF DESCRIPTION OF THE DRAWINGS

Exemplary embodiments of the invention will be described below in detail with reference to the drawings, in which.

DESCRIPTION OF PREFERRED EMBODIMENTS

Figure 1:
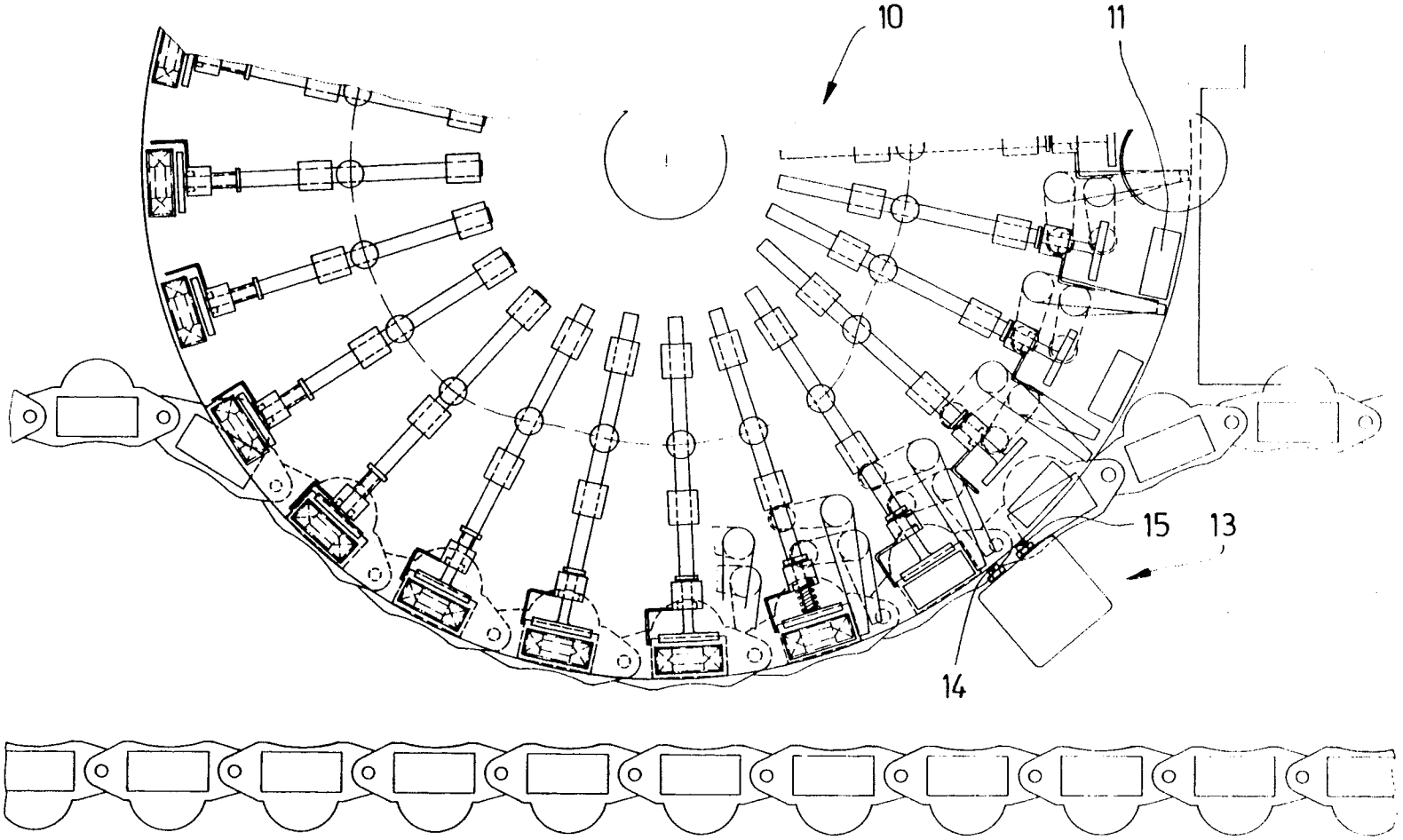
FIG. 1 is a side view of part of a packaging machine with a folding turret and a monitoring unit associated therewith.

The exemplary embodiments illustrated in the drawings are concerned with monitoring the folding means of a folding unit as regards correct shape or arrangement. In particular, the drawings show a rotating folding turret 10 which is provided at its outer periphery with folding mandrels 11 directed in an axis-parallel direction. These folding mandrels 11 are elongate hollow bodies made from a thin-walled metallic material (sheet metal) which in the present case have a rectangular cross-section. The folding mandrels 11 are open at both ends. These mandrels are known and customary means which are mainly used in the production of soft-cup packs for cigarettes. Blanks which are to form the packs are folded on the outer side of the folding mandrels 11 during the rotating movement of the folding turret 10. The presently embodied folding turret 10 is described and illustrated in detail in U.S. Pat. No. 4,852,335.

Figure 3:
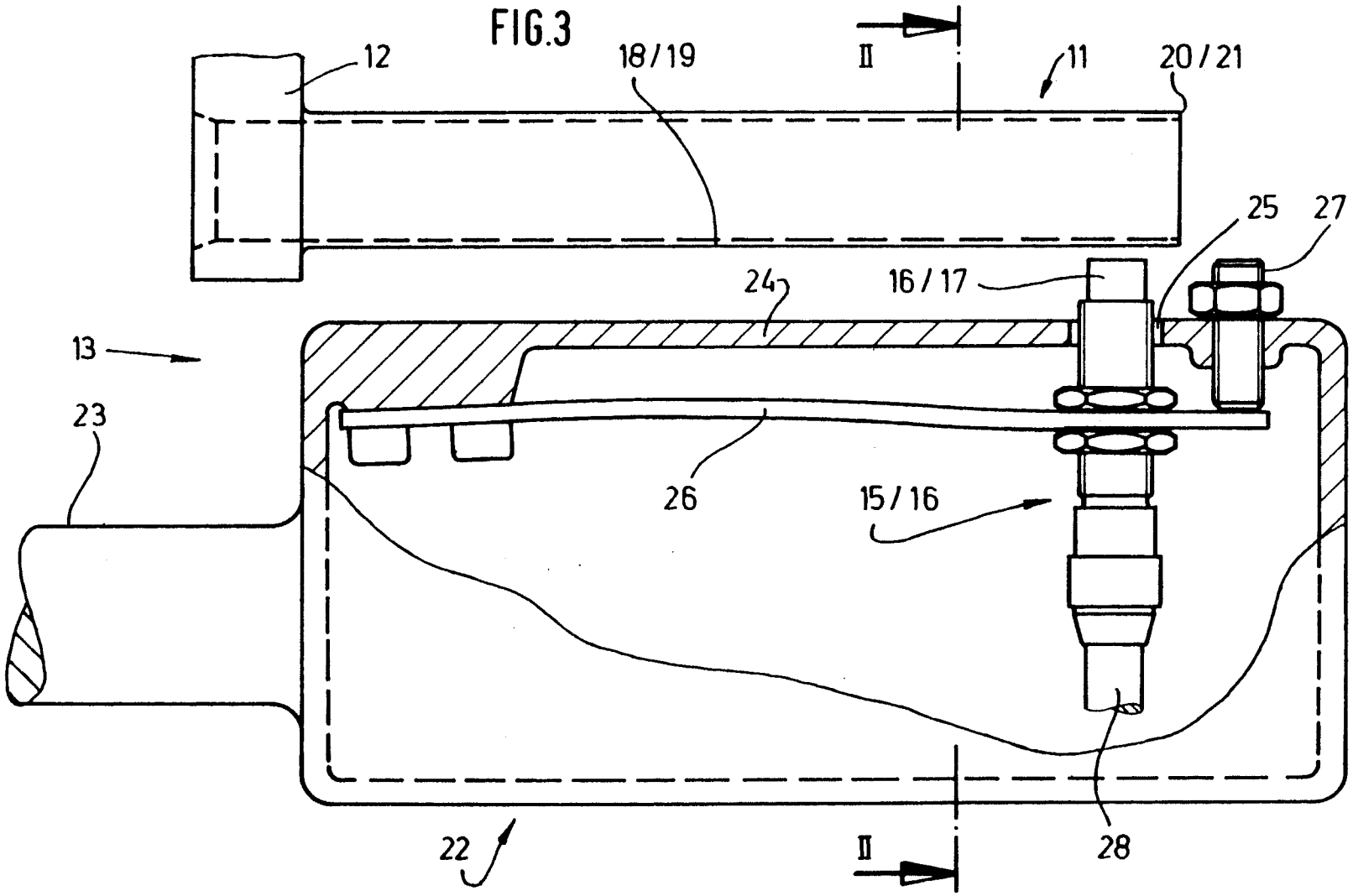
FIG. 3 is a partly sectional side view of the monitoring unit according to FIG. 2.
Figure 5:
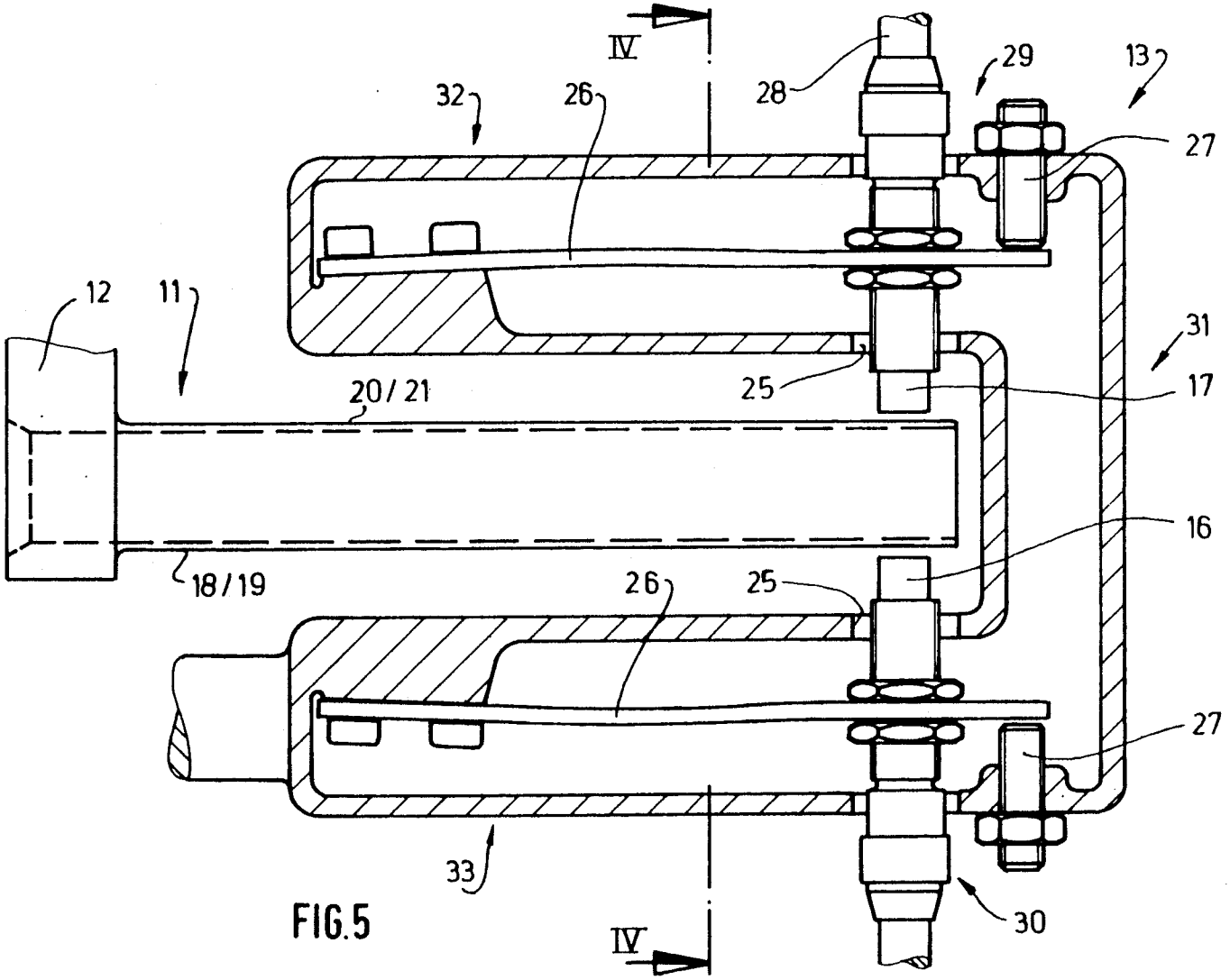
FIG. 5 shows a section of the monitoring unit according to FIG. 4, offset by 90° relative to the view of FIG. 4.

The folding mandrels 11 are unilaterally mounted on the folding turret 10, particularly on a turret disc 12 (FIGS. 3 and 5). The relatively long hollow body of the folding mandrel 11 consists of a thin-walled material and is therefore susceptible to mechanical stress. Consequently, the folding mandrels 11 may be deformed when the packaging machine is in operation.

In order to monitor the folding mandrels 11 as regards correct shape and arrangement on the folding turret 10, they are associated with a stationary monitoring unit 13. This unit is arranged stationary relative to the rotating folding turret 10 in such a way that the portion of the folding mandrels 11 which is monitored is free and not covered with a blank for the production of the pack.

Figure 2:
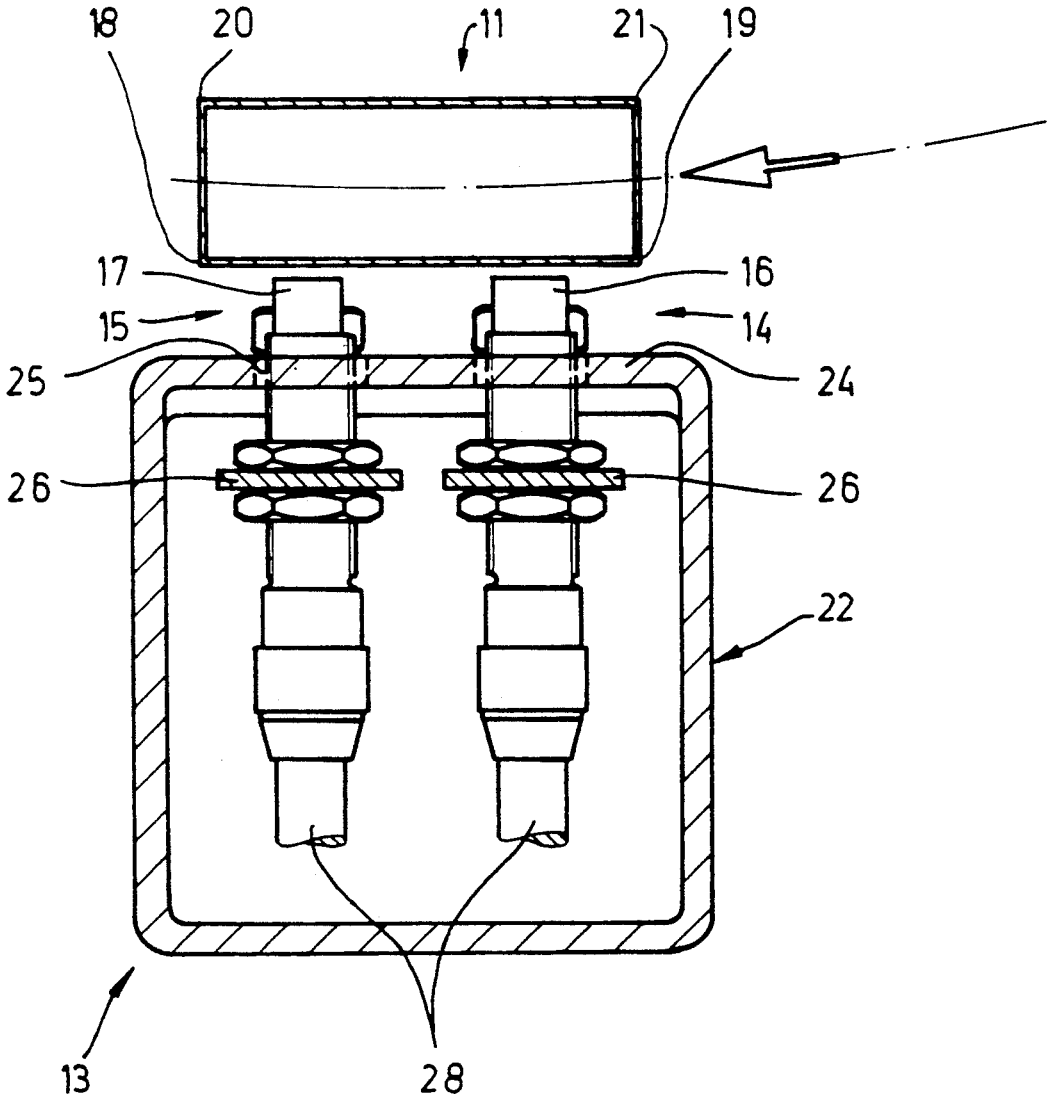
FIG. 2 shows a section of a (first) exemplary embodiment of a monitoring unit, taken along the line II—II of FIG. 3.

In the exemplary embodiment of FIGS. 1 to 3, the monitoring unit 13 is (exclusively) located on the radially outer side of the folding turret 10, that is to say of a circular path of movement of the folding mandrels 11. Accordingly;, the outwardly directed contours of the folding mandrels 11 are monitored and in particular traced without any contact. If any changes in the shape or relative position of a folding mandrel 11 are detected, the monitoring unit 13 generates an error signal which is assigned to the defective folding mandrel 11 so that it can be identified during a short standstill of the folding turret 10. The defective folding mandrel 11 will then be reshaped or replaced.

The folding mandrels 11 are distinctively marked, particularly with consecutive numbers. The monitoring unit 13 is connected to a control unit which comprises a recognition-signal disc whose position corresponds to the position of the folding turret 10 and therewith the folding mandrels 11. If a deformed folding mandrel 11 actuates an error signal, the recognition-signal disc at the same time identifies the relative position of the folding turret 10 and therewith of the respective folding mandrel 11. The packaging machine is provided with a display screen which pictures the folding mandrels 11. The defective folding mandrel 11 is identified on the screen and can thus be detected.

The monitoring unit 13 is provided with non-contact tracer means, in the present case particularly with proximity switches or inductive tracers 14 and 15. The structure of these inductive tracers is known per se. Each inductive tracer 14, 15 is provided with a tracer head 16, 17. A magnetic field is produced in the vicinity of the tracer head. The magnetic field has a limited effective range (switch range). If a metallic article enters the effective range of the inductive tracer 14, 15 or the tracer head 16, 17, the inductive tracer 14, 15 actuates a switching operation.

To monitor the contours and positions of the folding mandrels 11, longitudinal edges, 18, 19; 20, 21 of the folding mandrel 11 are traced. For this purpose, the tracer means (inductive tracer 14, 15) are arranged adjacent to the free end of the folding mandrel 11, i.e. as far as possible from the turret disc 12 supporting the folding mandrels 11.

In the exemplary embodiment of FIGS. 1 to 3, only the outer longitudinal edges 18 and 19 of the folding mandrel 11 are traced, particularly in such a way that deformations towards the outside and inside - with respect to the radial direction - are detected.

For this purpose, the inductive tracers 14, 15 or their tracer heads 16, 17 are arranged at different distances to the folding mandrels 11 and their longitudinal edges 18, 19. The inductive tracer 14 which comes first in the direction of movement is arranged such that each time the longitudinal edges 18, 19 of a correctly arranged folding mandrel 11 pass by, a switching operation is actuated. Accordingly, this distance is smaller than the switch range which in the present case is 4 mm. The inductive tracer 15 which follows in the direction of movement is spaced from the longitudinal edges 18, 19 at a distance which is greater than the given switch range. Accordingly, this inductive tracer 15 does not generate a signal if the folding mandrels 11 are correctly formed.

If there occurs a deformation which increases the distance of a folding mandrel to the inductive tracers 14, 15, the (first) inductive tracer 14 is not acted upon by the longitudinal edges 18, 19 any more. Accordingly, there are no more switching operations in this inductive tracer and the monitoring unit 13 produces an error signal.

In the case of a deformation of a folding mandrel 11 which decreases the distance of a folding mandrel to the inductive tracers 14, 15, both inductive tracers 14, 15 generate a signal because the longitudinal edges 18, 19 now also pass through the magnetic field of the second inductive tracer 15. Thus, the monitoring unit 13 produces an error signal.

In the case of torsional deformations of the folding mandrels, the inductive tracers 14, 15 react accordingly in response to the different distances.

An error signal indicating undesirable deformations of a folding mandrel 11 is assigned to the respective folding mandrel 11 as a result of suitable electronic or electrotechnical circuits. The folding mandrels 11 are approximately marked, for example consecutively numbered. When the folding turret 10 is at a standstill, the defective folding mandrel can thus be easily identified.

The monitoring unit 13 may be designed in different ways. It is, however, expedient to install the inductive tracers 14, 15 in an essentially closed housing 22. This housing is mounted on the machine frame via a supporting arm 23. The essentially closed housing 22 is provided with an orifice 25 so that the inductive tracer 14, 15 or the tracer head 16, 17 can pas through the housing in the region of a housing wall 24 which is facing the folding mandrels 11.

A specific holding device for the inductive tracers 14, 15 is disposed inside the housing 22. This device is a spring means, in the present case a leaf spring 26, which is fixed in the housing 22 in a biased manner. The inductive tracer 14, 15 is connected to the leaf spring 26 adjacent its free end.

The leaf spring can also be employed to ensure and vary the exact relative position of the inductive tracer 14, 15 and therewith the tracer head 16, 17. The free end of the leaf spring 26 can be varied and thus be accurately adjusted with regard to the distance by means of an adjusting means which is operated from the outside, particularly a grub screw 27.

An electric line 28 is connected to each inductive tracer 14, 15, particularly, on the one hand, for the supply of electric current and, on the other hand, for switching circuits.

Figure 4:
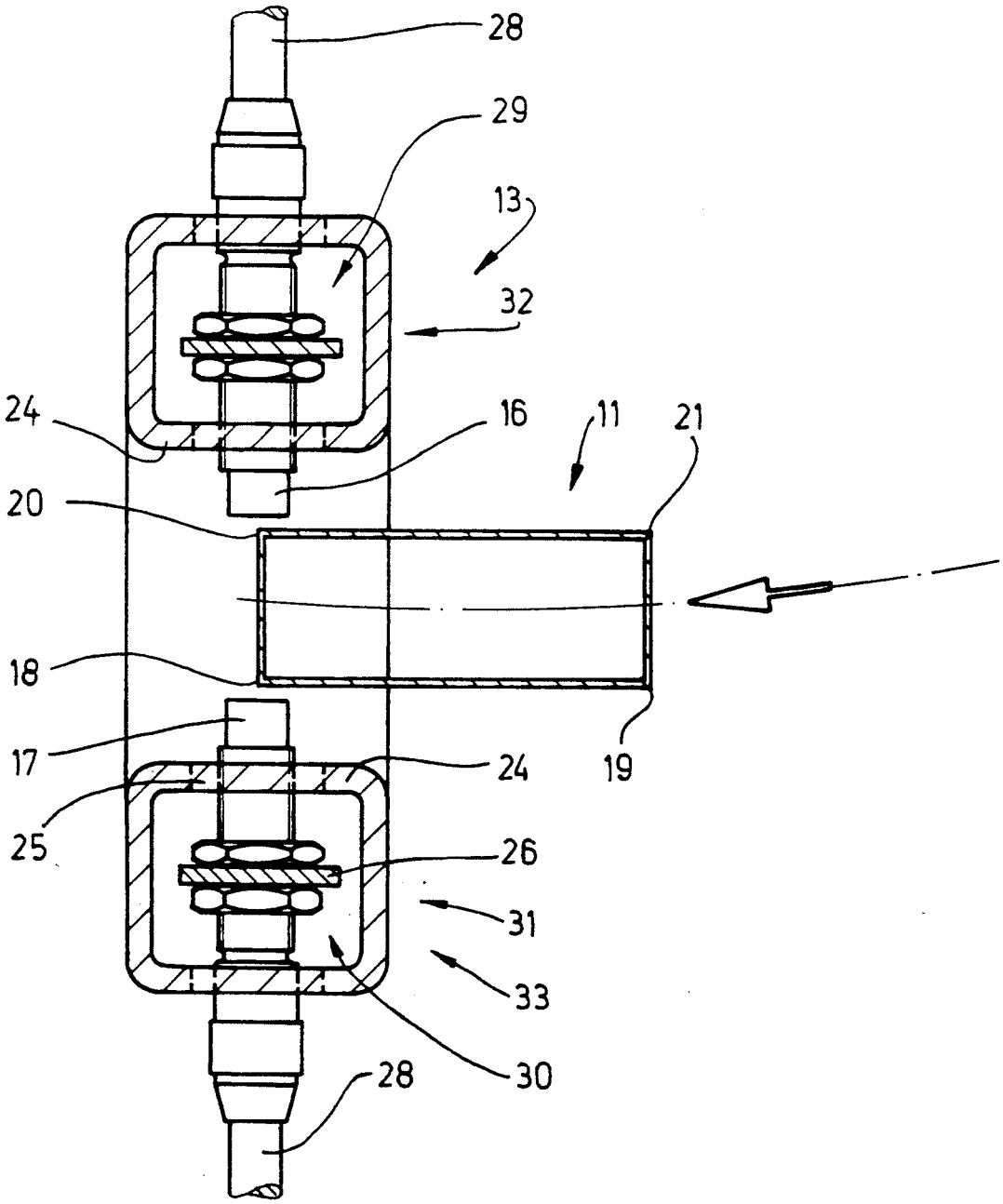
FIG. 4 shows a section of a second exemplary embodiment of the monitoring unit, taken along the line IV—IV of FIG. 5.

FIG. 4 and FIG. 5 show an alternative structure of the monitoring unit 13. Here, (two) inductive tracers 29, 30 are arranged on opposite sides of the circular path of the folding mandrels 11, which facilitates the switching operation. The inductive tracers 29, 30 can be spaced from the path of movement of the (correct) folding mandrels 11 at equal distances. This distance can either be within the switch range or outside. Deformations in the one or the other direction change the switching behavior of at least one inductive tracer 29, 30. In this exemplary embodiment, all four longitudinal edges 18..21 are therefore used for monitoring the position or shape of the folding mandrel 11.

The inductive tracers 29, 30 are accommodated in a U-shaped housing 31, such that each tracer is located in a leg 32 or 33 of said housing. The inductive tracers 29, 30 are mounted like those of the exemplary embodiment of FIGS. 2 and 3.

In the illustrated exemplary embodiments of the invention, the monitoring unit 13 is not constantly switched on, but is controlled such that in each case only the longitudinal edges 18, 19 or 20, 21 of the folding mandrels 11 are traced. The inductive tracers 14, 15 or 29, 30 are supplied with current accordingly.

I claim:

1. A folding turret for producing packs made from foldable blanks, said device comprising:

rotating supporting means having unilaterally mounted folding mandrels for the blanks; and a stationary monitoring unit (13) which is associated with the folding turret (10) and which monitors deformations of the folding mandrels (11) by detecting undesirable deformations of the folding mandrels (11) and generating an error signal that is assigned to a respective folding mandrel (11).

2. The device as claimed in claim 1, wherein said monitoring unit traces a contour and a position of each folding mandrel (11) in a non-contact manner.

3. The device as claimed in claim 2, wherein said monitoring unit traces the position of projections or markings at free end of said folding mandrels (11).

4. The device as claimed in claim 1, wherein the monitoring unit (13) is arranged in a region of the folding turret (10), in which the folding mandrels (11) are not provided with pack blanks.

5. The device as claimed in claim 1 or 2, wherein the monitoring unit (13) comprises at least one tracer means which is accurately positioned relative to a desired circular path of the folding mandrels (11) in a defined manner.

6. The device as claimed in claim 2, wherein two inductive tracers (14, 15) are arranged in parallel and one behind the other in a direction of rotation of the folding mandrels (11).

7. The device as claimed in claim 6, wherein the inductive tracers (14, 15) are arranged at different distances from a desired circular path of the folding mandrels (11), such that a desired circular path of longitudinal edges (18,19) of the folding mandrels (11) which are to be traced touches an effective range of one inductive tracer (14) and does not touch the effective range of the other inductive tracer (15).

8. The device as claimed in claim 7, wherein the inductive tracers (14, 15) are arranged at an outer side of the circular path of the folding mandrels (11).

9. The device as claimed in claim 1, wherein two inductive tracers (29, 30) are arranged on axially opposite sides of a circular path of the folding mandrels (11).

10. The device as claimed in claim 9, wherein the inductive tracers (29, 30) arranged on opposite sides of the circular path of the folding mandrels (11) are at equal distances from a desired circular path of the folding mandrels (11).

11. The device as claimed in claim 5, wherein the tracer means comprises inductive tracers (14, 15; 29, 30) arranged in an essentially closed and stationary holding housing (22; 31) from which tracer heads (16, 17) project.

12. The device as claimed in claim 11, wherein for each inductive tracer (14, 15; 29, 30) there is a biased spring means (26), and wherein one end of said spring means is tightly connected to the housing (22; 31) and another end is connected to the inductive tracer (14, 15; 29, 30) in order to spring-bias the latter.

13. The device as claimed in claim 12, wherein a free end of the spring means (26) bears against an adjusting device of the housing (22; 31) as a result of the bias of the spring means.

14. The device as claimed in claim 11, wherein the housing (31) has a U-shaped form and two legs (32, 33) arranged on axially opposite sides of the circular path of the folding mandrels (11), and wherein one inductive tracer (29, 30) is located in each of said legs (32, 33) in an adjustable manner, such that the tracer heads (16, 17) face towards one another.

* * * * *